United States Patent [19]

Laub, III, deceased et al.

[11] Patent Number: 4,817,683

[45] Date of Patent: Apr. 4, 1989

[54] ADJUSTABLE AUTOMATIC ACCURATE CONTAINER FILLING MACHINE

[75] Inventors: Herman Laub, III, deceased, late of San Gabriel, by Louise M. Laub, executrix; Edward S. Hunt, Glendale, both of Calif.

[73] Assignee: Laub Engineering Corporation, Alhambra, Calif.

[21] Appl. No.: 69,398

[22] Filed: Jul. 1, 1987

[51] Int. Cl.[4] ..... B65B 3/12

[52] U.S. Cl. ..... 141/1; 141/144; 141/147; 141/152; 141/258; 137/625.69

[58] Field of Search ..... 141/129, 135, 136, 137–145, 141/147, 128, 151, 153, 155, 156, 163, 165, 168, 171, 181–183, 250, 251, 258, 260, 261, 266, 284, 1, 83, 44–46, 115, 116; 137/625.17, 625.18, 625.25, 625.67, 625.69, 625.33, 625.33, 625.34, 625.48

[56] References Cited

U.S. PATENT DOCUMENTS

| | | | |
|---|---|---|---|
| 1,913,656 | 6/1933 | Boyd | 141/147 |
| 1,953,643 | 4/1934 | Calleson | 141/153 X |
| 2,762,546 | 1/1953 | Aidlin | 141/101 |
| 3,419,053 | 12/1968 | Tanner | 141/145 |
| 3,595,281 | 12/1969 | Laub, III | 141/46 |
| 3,870,089 | 3/1975 | Laub, III | 141/44 |
| 4,060,109 | 11/1977 | Sotoma | 141/83 |
| 4,095,628 | 6/1978 | Laub, III | 141/367 |
| 4,300,603 | 11/1981 | Laub, III | 141/258 |
| 4,606,382 | 8/1986 | Biller et al. | 141/1 |
| 4,635,688 | 1/1987 | Graffin | 141/1 |
| 4,676,286 | 6/1987 | Aiuola et al. | 141/145 |

*Primary Examiner*—Henry J. Recla
*Assistant Examiner*—Ernest G. Cusick
*Attorney, Agent, or Firm*—Sheldon & Max

[57] ABSTRACT

Containers are filled with flowable substances while passing through a filling station. The plurality of nozzles and cylinders move through the filling station in unison with the containers. The cylinders have a free flowing piston movable under fluid action alternately to charge and discharge from alternate ends. A spool valve operates with respective cylinders under mechanical activation to charge and discharge cylinders and permit fluid from the supply to feed the respective nozzle. One cylinder end receives a stop rod which can be variably located into the cylinder and thereby to adjust the cylinder volume. The rod can be adjusted precisely as the vertical location of a mounting plate varies, which can be effected during operation of the filling machine. The cylinder length to diameter is substantially elongated to make for precision adjustments of cylinder volume as the rod is located variably into and from the cylinder. A highly precise adjustable filling system is achieved.

56 Claims, 4 Drawing Sheets

ADJUSTABLE AUTOMATIC ACCURATE CONTAINER FILLING MACHINE

BACKGROUND OF THE INVENTION

This invention relates to filling containers, such as bottles with flowable substances. In particular the invention is directed to filling automatically containers with fluids which are flowable and range from viscous and thin to substances which readily form suds or foams.

The filling of such containers needs to be accurately effected, and for this purpose the filling mechanism should be easily adaptable to different kinds of fluids, changing working environments and conditions of the fluid, such as temperature. This is necessary so that an accurate control of fluid content where volume and weight are interrelated can be maintained. Small variations in the amount of fluid in different containers can amount to substantial aggregate variations and deficiencies where thousands of containers have been filled. Additionally each container can be inaccurate in its contents.

It is known to fill containers rapidly and accurately in a manner indicated in U.S. Pat. No. 3,870,089 (Laub III). In the system there disclosed, containers are fed onto a rotating turntable, and filled by nozzles. A cylinder has a piston and fluid in a cylinder from either side of the piston passes through a valve system into a respective nozzle filling the containers. The valve system operates under compressed air. There is thus a fluid system additional to the fluid supply for filling containers. This system is relatively complex and, due to the compressed air system, fairly noisy. Moreover, the cylinders and the respective pistons are not easy to adjust for different fluid conditions, weights and volumes of fluid and variations in containers.

In a further example of the prior art, namely U.S. Pat. No. 1,913,656 (Boyd) there is disclosed a filling machine for grease wherein the cylinder size is variable and thereby the volume of the cylinder is adjustable. A block is movable upwardly and downwardly by turning a screw. This adjustably limits the piston movement in the cylinder. The configuration of the cylinders and its adjustability is of a nature whereby precise adjustments for fluid flow from the cylinders into the containers is relatively difficult. Also there is a rotary valve operable with the cylinder which is relatively complex in operation and difficult to set for accurate filling.

In another example of the prior art, namely U.S. Pat. No. 3,419,053 (Tanner) there is disclosed a similar container filling machine. In this machine the cylinder volume is adjustable by having the end caps for the cylinders movable relative to the cylinder sleeve body. The valve mechanism operates with rotary valve devices in a manner which is relatively complex.

Another example of the prior art is U.S. Pat. No. 2,762,546 (Aidlin) which discloses an electric solenoid operated valve for effective charging and discharging of a cylinder. This system is also relatively complicated, and the piston structure and its rod connection hinders movement in the cylinder. No indication is given for adjustment.

There accordingly exists a need for a container filling machine which is easy to control and is accurate and consistent in performance and easily adjustable for different conditions and volumes.

SUMMARY OF THE INVENTION

Accordingly, the invention seeks to meet the need for accurate container filling, and for adjustability as required with mechanisms which are direct and effective in operation.

According to the invention filling of containers with a flowable substance comprises passing the containers along the rotary path through a filling station. A plurality of nozzles and a plurality of cylinders pass with the containers through the filling station. Each cylinder has a free floating piston movable towards either end of the cylinder, the piston being product driven. A valve associated with each respective cylinder alternately connects the supply to respective ends of the cylinder for charging the cylinder, and the valve alternately connects the nozzle to a respective opposite end of the cylinder whereby fluid from the supply and/or connected cylinder end can discharge into a container.

There is operating means to activate mechanically the valve, which is a spool valve having a hollow spool with ports in the spool. The mechanical activating means includes an interacting member with two elements relatively stationary and circumferentially disposed in spaced relationship about the turntable. When the turntable is in a first position, the valve is interacted into a first position, and when the turntable is in the second position, the valve is interacted into a second position.

Also according to the invention the piston includes indentations in the form of a conical inward taper in the end faces. One end face will mate with the indentation at the end of a rod which acts as a variable stop to one end of the cylinder. The indentations act to accommodate excess flowable substance when the piston bottoms or rises to the top of the cylinder. This avoids planing and ensures accurate delivery of substantially all the product from the cylinder to the container.

Further according to the invention the stop is adjustably mounted on a horizontal plate which is vertically movable while the conveyer is operative.

Other aspects of the invention are further exemplified in the accompanying drawings.

DESCRIPTION OF THE PREFERRED EMBODIMENT

Figure 1:
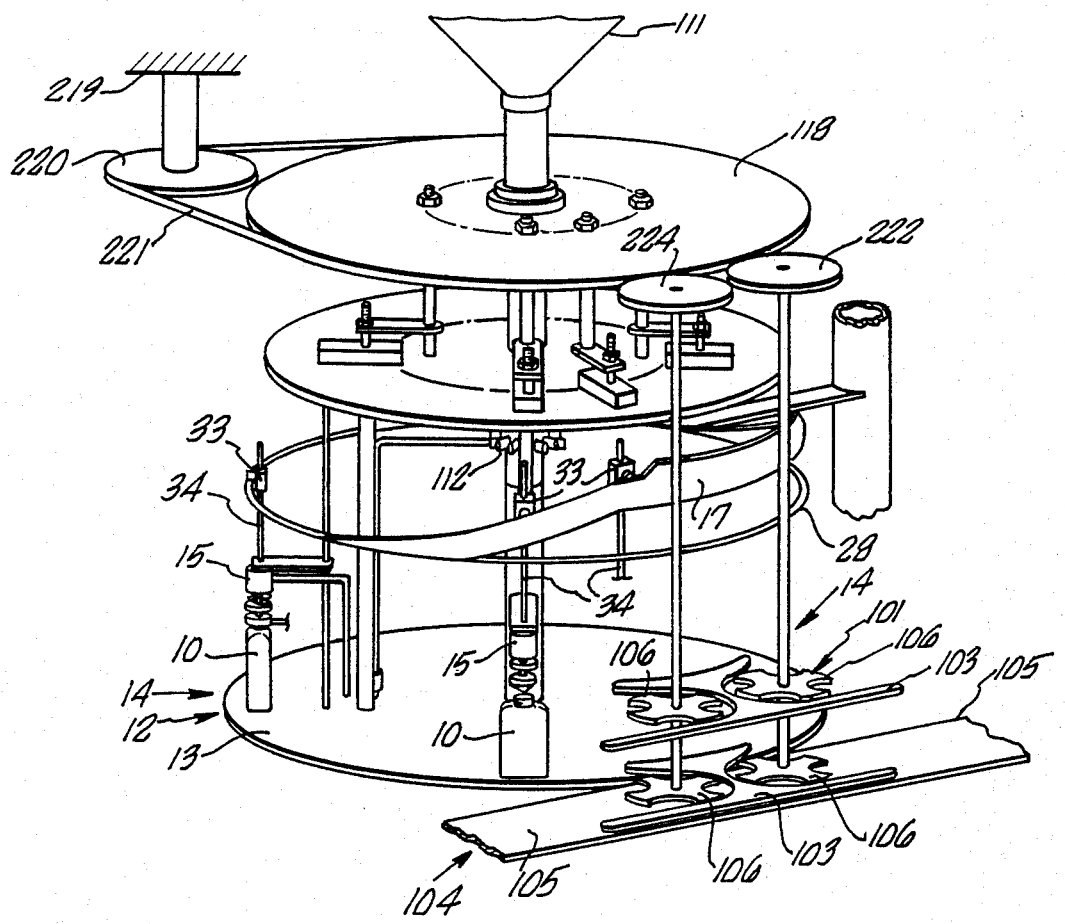
FIG. 1 is an overall perspective view illustrating filling containers on a rotary turntable conveyer with various components of the filling machine.
Figure 2:
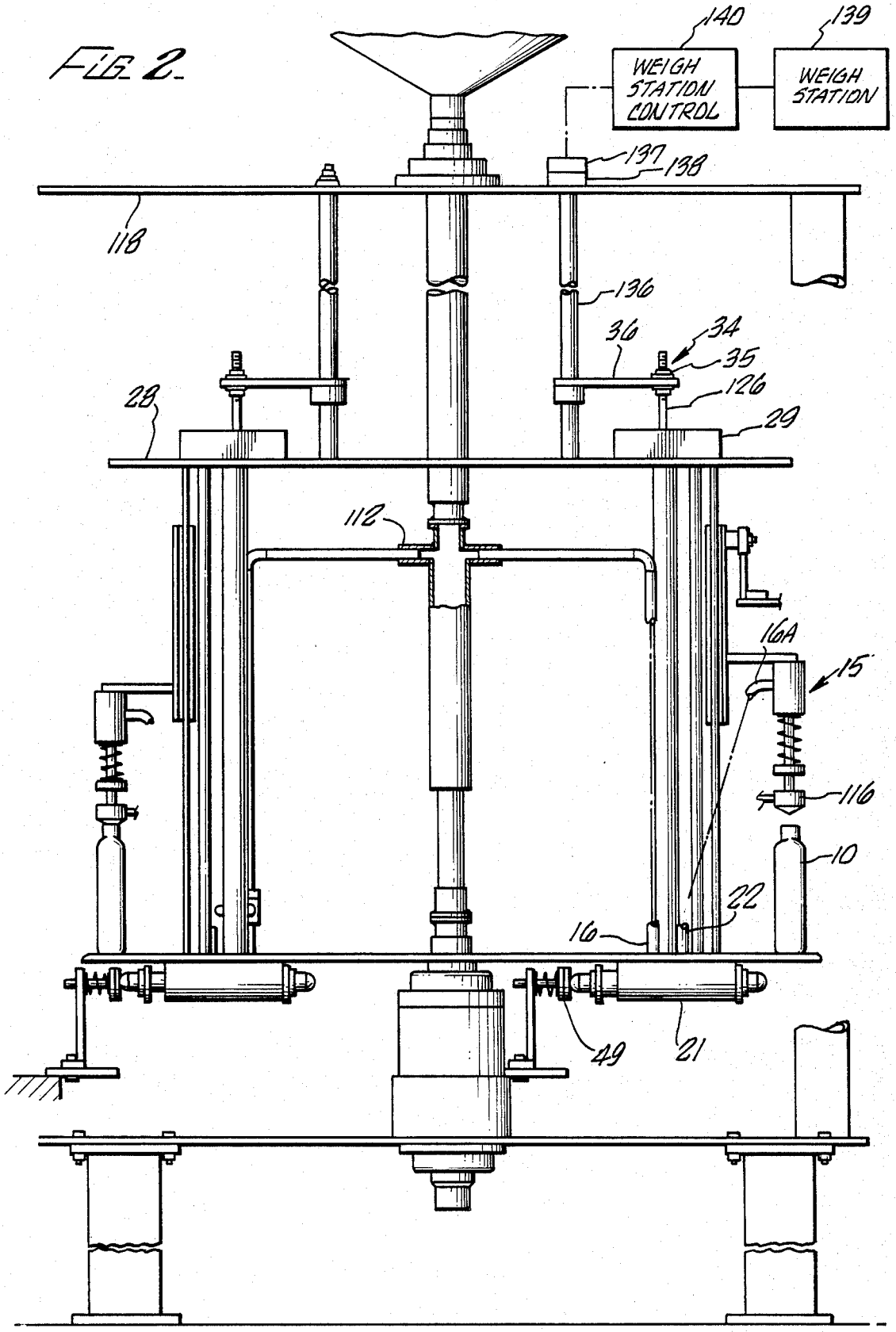
FIG. 2 is a flow diagram illustrating the interrelationship between the cylinder, valve and nozzle and the interacting members for operating on one side of the valve.
Figure 3:
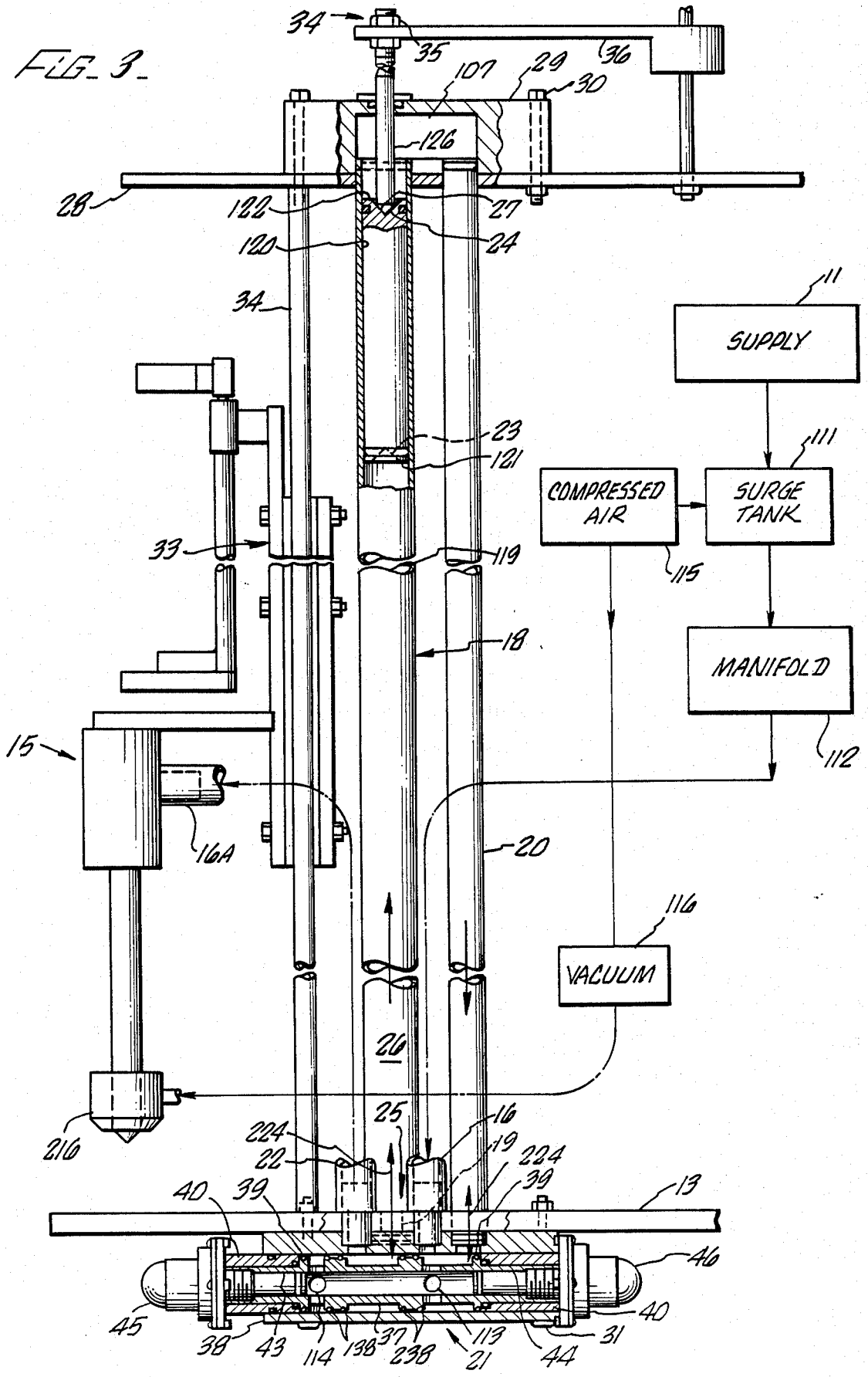
FIG. 3 is an enlarged side view of components also showing a flow diagram illustrating the interrelationship of the cylinder, valve and nozzle relationship.

Apparatus for filling containers 10 with a flowable substance from a supply 11 comprises a rotary turntable conveyer 12 for conveying containers 10 about a rotary path. The rotary conveyer is constituted by a turntable 13 which at one position 101 receives containers 10 from a conveyer delivery system 102 for filling and from another position 103 discharges the filled containers 10 to a conveyer discharge system 104. Each system has an endless conveyer 105 and a pair of rotatable wheels 106 for locating and moving the containers 10 as required relative to the turntable 13.

The rotary path passes through a filling station area 14 where a plurality of nozzles 15 fill a flowable substance from the supply 11 through supply pipe 16A.

The nozzles 15 are mounted relative to a stationary circumferential cam plate 17 so that as the turntable 13 rotates and the nozzles 15 rotate about the path, the nozzles 15 can move upwardly and downwardly relative to the containers 10. A drive plate 118 is connected with a motor 219 through a gear 220 and sproket drive chain 221. The gear wheels 222 operate the delivery and discharge wheels 106.

A plurality of cylinders 18 are arranged regularly and circumferentially about the turntable 13 and are mounted above the turntable 13. The cylinders 18, through pipes 19 and 20 respectively from each end of the cylinder, connect with a spool valve assembly 21. The outlet pipe 22 from the spool valve feeds the nozzles 15.

The cylinder 18 includes an elongated sleeve 119. The ratio of the length of the sleeve relative to the internal diameter of the sleeve is at least greater than about 10 to 1. Riding in the elongated sleeve 119 is a free piston 120 which has opposite end faces 121 and 122 respectively. Centrally located within the end faces 121 and 122 are conical inward tapers 23 and 24 respectively. The effect of the inward taper or indentation 23 is that when the piston 120 moves towards the bottom 25 of the cylinder 18, any fluid which is located in the end of the cylinder body 26 near the bottom 25 enters the indentation 23. This ensures positive bottoming of the piston 120 on the bottom 25 and thus accurate discharge of fluid from the end of the cylinder body 26 through the valve assemblies 21. A mating taper 24 is put on the top end 122 of the piston 120. This engages a stop rod 126 which is provided with a mating 45° pointed tapered end 27 for location in the tapered indentation 24.

The cylinder 18 is mounted about the turntable 13 and below a rotatable mounting plate 28 on which is secured a manifold body 29 by means of bolt anchors 30. Bolts 31 with the turntable 13 secure both the valve assembly 21 and the cylinder 18 to the turntable plate 13. In this manner the cylinder 18 is firmly anchored between the plates 13 and 28. An aperture 107 through the manifold body 29 permits the stop rod 126 to pass variably and adjustably into the cylinder body 26 to varying degrees vertically downwardly or upwardly. In this manner the piston 120 is adjustably regulated in the extent of travel in the cylinder 18, and in this way the degree of fluid that is delivered to and discharged from the cylinder body 26 is variable.

Adjacent the cylinder 18 is the return tube 20 which is substantially parallel located with the cylinder elongated sleeve 119. The lower end of the tube fits into the valve assembly 21 and the upper end of the tube 20, connects with the upper end of the cylinder elongated sleeve 119 through body 29. These connections are in fluid communication so that fluid within the cylinder 18 can be discharged reciprocally into the valve 21 or fed into the cylinder 18 via the valve 21. The fluid thus oscillates substantially forwards and backwards between the cylinder body 26 and valve assembly 21. This controls fluid flow from the supply pipe 16 passing through the valve assembly 21 to the nozzle 15. Effectively the fluid driving the piston 120 also operates with the spool of the valve assembly 21 in the different operative positions. Fluid from the supply pipe and/or the respective end of the cylinder connected through the valve assembly 21 flows to the nozzle.

Also adjacent the elongated sleeve 119 is a slider assembly 33 which rides on a support rod anchor 34 so that the nozzle 15 can move upwardly and downwardly in reciprocating motion to and from the top of containers 10 when located on the conveyor at different locations at the filling station area 14. The movement of the nozzles 15 up and down is regulated by the cam plate 17.

The valves 21 are associated with respective cylinders 18 for alternate connecting the supply 11 to respective ends of the cylinder 18 to either side of the piston 120. The cylinder 18 is charged by the supply 11 from one side while a nozzle 15 is connected through the valve 21 for discharging the opposite side of the cylinder 18 into the container 10. When the piston 120 moves in the reverse direction the charging and discharging is reversed. Effectively the fluid in the cylinder body 26 largely remains in the cylinder 26, valve 21 and connecting pipe structure while oscillating backwards and forwards, and fluid from the supply 11 connects and discharges fluid through the valves 21 to the nozzles 15. The structure is such that, each cylinder 18 from the piston's upward and downward stroke will collectively effectively ensure filling the container 10 from the supply 11, through the valve 21, which is operable with the respective nozzle 15.

The opposite end 34 to the free end 27 of the stop rod 126 is connected with bolt means 35 to a volume plate 36 which is adapted for upward and downward adjustable movement. The plate 36 is connected through shaft 136 to a gear-motor 137 and brake-clutch 138 system through a sprocket and chain drive mechanism. Suitably operating the gear motor 137 and brake-clutch 138 system with the sprocket chain interaction effectively turns the shaft 136 and moves the plate 36 upwardly and downwardly. This operation of moving the plate 36 variably adjusts the depth that stop rod 126 penetrates into the cylinder body 26. Operation of the gear-motor 137 brake-clutch 138 system on the volume plate 36 can be effected while the container filling apparatus is operable. There is thus no down time necessary for effecting vertical adjustment of the volume plate 36. Hence the volume of the cylinder 18 and the amount of flowable substance to be delivered by the supply 11 to the nozzle 15 and its respective container is similarly adjustable.

The volume delivery can be fine tuned through the bolt means 35 interrelationship between the rod 126 and its threaded opposite end 34 with the plate 36. A one-sixth turn of the bolt means 35, which is equivalent to rotation of the bolt means through one flat (namely, in a hexagonal bolt, the location of an adjacent flat side of the bolt in the prior location of an a adjacent flat side of the bolt), enables adjustment of the cylinder volume to 1/10 gram of water by weight where the cylinder structure is such that the length is about 24 to 36 inches, and the internal diameter is about $1\frac{1}{4}$ inch to $1\frac{3}{4}$ inch. In some other cylinder construction, where the length is about 12 to 16 inches and the cylinder diameter is 4 to 6 inches internally, a one-sixth turn of the nut bolt mechanism 35 effects a $\frac{1}{2}$ gram of water by weight differentiation in the delivery from the cylinder to nozzle 15.

By having the elongated long cylinder 18 with the ratio between the length and internal diameter of at least 10 to 1, it is possible to have highly accurately controlled discharge and filling of containers 10 through nozzle 15.

By permitting adjustment of the plate 36 during operation which may be necessary to environmental changes, for instance, temperature changes during the day in the filling plant, accurate ongoing and continuing control is possible of container filling without down time.

A weigh station 139 downstream the filling station of the conveyor 104 can feedback information to operate to the gear-motor 137 and brake-clutch 138 system. Changes in delivery weight as sensed at the weigh station 139 can automatically through a weigh system control 140 operate the gear-motor 137 and brake-clutch 138 system on a continuum to ensure regulated control of container filling.

The spool valve assembly 21 which is mounted below the turntable 13 includes a hollow spool 37 for reciprocating motion within a valve spool sleeve 38. The valve assembly 21 is radially arranged like the spokes of a wheel about the rotational axis of the turntable 13, and the valves 21 are circumferentially spaced about the turntable 13.

About the spool 37 there are outer spool O-rings 238 and inner spool O-rings 39. These O-rings associated with each of the spool rings 238 and 39 ensure effective sealing with the spool sleeve 38 and bushings 40 respectively. The spool 37 is hollow and has port 113 at one end for fluid to enter the spool 37, and port 114 at the opposite end to discharge fluid from the spool 37.

There are stems 43 and 44 which enter through the bushings 40 and are in engagement with the spool 37. The arrangement provides for reciprocation of the stems 43 and 44 when the hemispherical castor-ballbearing elements 45 and 46 respectively interact with interacting members 47 and 48.

By operating the valve spool 37 in this reciprocating fashion and as described more fully below the cylinder ends charge and discharge through the valve 21. Fluid from the supply 11 effectively feeds the nozzle 15, while fluid in the cylinder ends reciprocates as indicated by arrows 224 between the cylinder 18 and valve 21.

Figure 4:
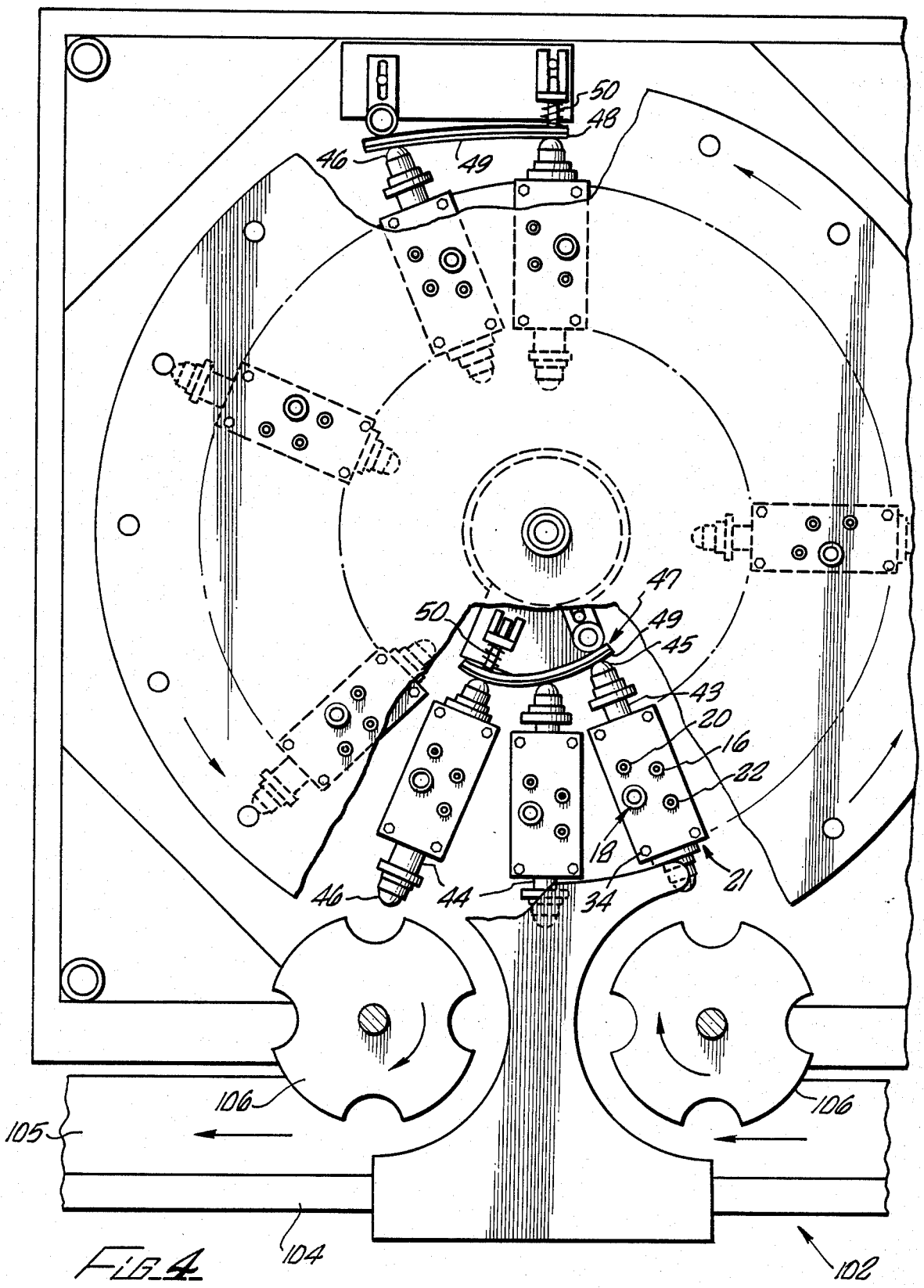
FIG. 4 is a plan view with parts broken away illustrating the arcuate sections of the interacting members in relationship to the spool valve.

About the turntable 13 at about 180° offset from each other is an internal interacting member 47 and an external interacting member 48. Each of these members includes an arcuate section 49 circumferentially disposed about the turntable 13. The outwardly directed ball bearing face 45 of the valve 21 engages the internal arcuate section 49 as the turntable 13 passes the interacting member 47 and acts to urge the spool 37 radially outwardly as the turntable rotates clockwise, as illustrated in FIG. 4. When the valve body 21 is in the opposite topmost position, as illustrated in FIG. 4, the ball bearing element 46 engages the arcuate section 49 which acts to urge the spool 37 radially inwardly. These two configurations of the spool 37 relative to the spool sleeve 38 act to place the spool valve 21 in its two operative states and thereby act to put the cylinder 18 in its two operative states.

Each of the interacting members 47 and 48 with the cam profile include a spring mounting 50 which urges the respective arcuate faces 49 towards the interacting castor ball bearing elements 45 and 46 respectively. By having the spring loaded unit small mechanical differences arising from construction and location of the valves 21 relative to the turntable 13 and the interacting members are overcome. This permits for construction of the filling apparatus in a manner to ensure accuracy of operation.

In operation of the filling apparatus containers 10 enter the rotary conveyer 12 and are fed to the filling station area 14. Interaction of the slider assembly 33 with the cam 17 ensures that the nozzle 15 is lifted or lowered as required to ensure that entry of the nozzle 15 into the top or neck of containers 10. The containers 10 are thus filled as they pass along the path of the filling station area 14. The valves 21 react with the respective interacting members 47 and 48 to ensure that fluid from the supply 11 passes into a surge tank 111, then to a manifold 112 and in turn through pipe 16 and into the valve body 21 through valve spool 37. The piston 120 is respectively driven to its respective opposite ends on either side of the cylinder 18. In this manner fluid discharges respectively from either side of the piston 120 to the valve 21. Fluid enters the valve spool 37 from supply 11 in port 113 and discharges via port 114 and pipe 22 to fill the containers 10 during the travel on the turntable 13.

The surge tank is connected with a compressed air supply 115 which pressurizes the tank 111 as required. The compressed air supply 115 also connects with a vacuum source 116 to operate with the tip 216 of the nozzle 15 to prevent unnecessary dripping from the nozzle 15.

The accurate mechanical interaction of the arcuate sections 49 by the reciprocating interaction of the spool or shuttle 37 of the spool valve 21 provides for positive action. This is transferred to positive action of fluid flow into and from the cylinders 18. The cylinder construction 18 being elongated and being adjustable at its one end through the rod 126 permits for precise setting of cylinder volume size. This, being adjustable in a fine tuning manner by the bolts 35 and plate 36 and while the apparatus is in operation by movement of plate 36, provides for an efficient and relatively simple manner of ensuring that the containers filling quantities are accurately set and maintained during operative cycles. The overall characteristics of the filling apparatus and method provides a system which is enhanced in its operation, and yet is relatively simple in its structure with high performance features.

It will be appreciated that many other forms of the invention exist without departing from the principles described. The fluid may be of a relatively viscus thin nature or a relatively thick foamy consistency, and the adjustments for fluid flow can be made. The containers may be bottles, cans, or similar receptacles. The conveyer may be of the rotary endless kind or a non-rotary in line system. Different drive configurations are possible for the filling apparatus.

The scope of the inventin is to be determined by the appended claims.

We claim:

1. Apparatus for filling containers with a flowable substance from a supply comprising means for conveying containers along a path, the path passing through a filling station, a plurality of nozzles for movement along at least part of the path together with the associated containers, a plurality of cylinders mounted for movement along at least part of the path together with the containers, each cylinder having respective opposite ends and each cylinder having a free piston movable in each cylinder towards opposite end of the cylinder, the piston having no extension from each respective cylinder, a plurality of spool valve assemblies associated with each respective cylinder for alternately connecting respectively each valve assembly to the respective opposite end of the each cylinder for charging and discharging the respective opposite ends with the flowable substance, each valve assembly alternately connecting a nozzle to a respective opposite end of a cylinder for discharging the flowable substance from the supply and/or connected cylinder end into a container, and means for mechanically operating the valve assemblies to regulate supply of the flowable substance into the container.

2. Apparatus as claimed in claim 1 wherein the path includes a rotary conveyer having a turntable, the cylinders being mounted above the turntable and the valve assemblies being mounted in adjacency with the cylinders below the turntable.

3. Apparatus as claimed in claim 2 wherein each cylinder has a cylinder volume, and including a stop for entering one end of each cylinder, the stop being adapted for location in each cylinder to variable levels thereby effectively to adjust the cylinder volume.

4. Apparatus as claimed in claim 3 wherein the stop is a rod, the rod having a free end adapted to engage the free piston, and the end of the rod opposite the free end being adjustably mounted with a support thereby to vary the location of the rod relative to the cylinder.

5. Apparatus as claimed in claim 3 wherein the stop is adjustable during rotation of the turntable.

6. Apparatus as claimed in claim 4 wherein the support is a horizontal plate vertically movable thereby to adjust the location of the rod in the cylinder.

7. Apparatus as claimed in claim 4 wherein the piston includes ends having an indentation, and wherein the free end of the rod includes an end to mate with the indentation in the one end of the piston.

8. Apparatus as claimed in claim 7 wherein the indentation is a conical inward taper.

9. Apparatus as claimed in claim 6 wherein the stop is adjustable during rotation of the turntable.

10. Apparatus as claimed in claim 2 wherein each valve assembly includes an elongated sleeve body mounted radially relative to a rotational axis of the conveyer, the conveyer being a circular turntable with a circumference.

11. Apparatus as claimed in claim 10 wherein the sleeve body includes an elongated casing with a valve spool adapted for axial reciprocating movement in the casing, such axial movement being radial relative the rotational axis, and the means for mechanically operating the valve assemblies includes interacting members located partly about the circumference of the turntable, the interacting members being stationary relative to the turntable.

12. Apparatus as claimed in claim 11 wherein the interacting members are spaced circumferentially about the turntable, and the interacting members include a first element and a second element, and whereby in one circumferential position of the turntable the valve spool interacts with the first element of the interacting members to activate the valve assembly into a first position and in a second circumferential position the second element of the interacting members interacts with the valve spool to activate the valve assembly into a second operative position.

13. Apparatus as claimed in claim 12 wherein the elongated casing includes opposite ends to the sleeve body, and the valve spool includes extensions protruding from the valve casing to end of the valve casing, the extensions being for interaction respectively with the first and second elements of the interacting members.

14. Apparatus as claimed in claim 13 wherein the extensions to the valve spool include a hemispherical end and the elements of the interactive members are arcuate sections spaced circumferentially about the turntable.

15. Apparatus as claimed in claim 10 wherein the arcuate sections are spring loaded towards the spool valve assemblies.

16. Apparatus as claimed in claim 1 wherein each cylinder has a length to internal diameter ratio of greater than about 10:1.

17. Apparatus as claimed in claim 1 wherein the piston includes ends having at least one indentation.

18. Apparatus for filling containers with a flowable substance from a supply comprising means for conveying containers about a rotary path, the path passing through a filling station, a plurality of nozzles for movement along at least part of the path together with the associated containers, a plurality of cylinders each having a volume mounted for moving along at least part of the path together with the containers, the cylinders having respective opposite ends, and each cylinder having a free piston movable in each cylinder towards opposite ends of the cylinder, a plurality of spool valve assemblies associated with each respective cylinder for alternately connecting respectively opposite ends of the cylinder for charging and discharging the respective cylinder opposite ends with a flowable substance, each valve assembly alternately connecting a nozzle to a respective opposite end of a cylinder for discharging the flowable substance from the supply and/or connected cylinder end, a stop for entering one end of the cylinder, the stop being adapted for location in the cylinder to variable extends thereby to adjust the cylinder volume, the stop being adjustable during container filling, and means for mechanically operating the valve assemblies.

19. Apparatus as claimed in claim 18 wherein the stop is a rod, the free end of the rod being adapted to engage the free piston, and the opposite end of the rod being adjustably mounted with a support thereby to vary the rod location relative to the cylinder.

20. Apparatus as claimed in claim 18 wherein each cylinder has a length to internal diameter ratio of greater than 10.1.

21. Apparatus as claimed in claim 20 wherein each valve assembly includes an elongated sleeve body mounted radially relative to a rotational axis of the conveyer, the conveyer being a circular turntable having a circumference.

22. Apparatus as claimed in claim 21 wherein the valve sleeve body includes an elongated casing with a valve spool adapted for axial reciprocating movement in the casing, such axial movement being radially directed relative the rotational axis, interacting members having a first element and a second element located partly about the circumference of the turntable, the interacting means being stationary relative to the turntable, and the interacting means being spaced circumferentially relatively about the turntable whereby in one circumferential position of the turntable the valve spool interacts with the first element of the interacting member to activate the valve into a first position and in a second circumferential position the second element of the interacting member interacts with the valve spool to activate the valve into a second operative position.

23. A method for filling containers with a flowable substance from a supply comprising conveying containers along a path, the path passing through filling station, moving a plurality of nozzles along at least part of the path, together with the containers, moving a plurality of cylinders having opposite ends along at least part of the path together with the containers, each cylinder having a free piston movable in the cylinder towards opposite ends of the cylinder each piston having no extension from each cylinder, each cylinder end being in fluid communication with a respective spool valve, alternately connecting a spool valve with opposite ends of an associated cylinder, and connecting the supply with an associated nozzle whereby fluid from the supply and/or cylinder fills the containers, the valves being mechanically operated.

24. A method as claimed in claim 23 wherein the path is circular and including rotating a rotary conveyer having a turntable along the path.

25. A method as claimed in claim 24 wherein the cylinder has a volume and including adjusting the cylinder volume by entering one of the opposite ends of the cylinder with a stop for location in the cylinder to a variable extent.

26. A method as claimed in claim 25 including engaging the free piston with the stop and adjustably mounting the stop with a support.

27. A method as claimed in claim 26 including a rotational axis and a circumference for the turntable, and axially reciprocating a valve spool in a casing, such axial movement being radially directed relative the rotational axis, and operatively interacting the valve with the interacting members located partly about the circumference of the turntable.

28. A method as claimed in claim 26 including moving the support vertically thereby to adjust the location of the stop in the cylinder.

29. A method as claimed in claim 28 wherein the stop is adjustable during rotation of the turntable.

30. Apparatus for filling containers with a flowable substance from a supply comprising means for conveying containers along a path, the path passing through a filling station, a plurality of nozzles for movement along at least part of the path together with the associated containers, a plurality of cylinders mounted for movement along at least part of the path together with the containers, each cylinder having respective opposite ends and each cylinder having a free piston movable in each cylinder towards opposite ends of the cylinder, the piston having no extension from each respective cylinder, a plurality of spool valve assemblies associated with each respective cylinder for alternately connecting respectively each valve assembly to the respective opposite end of the each cylinder for charging and discharging the respective opposite ends with the flowable substance, each valve assembly alternately connecting a nozzle to a respective opposite end of a cylinder for discharging the flowable substance from the supply and/or connected cylinder end into a container, and means for mechanically operating the valve assemblies to regulate supply of the flowable substance into the container, wherein each cylinder has a cylinder volume, and including a stop for entering each cylinder, the stop being adapted for location in each cylinder to variable positions thereby effectively to adjust the cylinder volume.

31. Apparatus as claimed in claim 30 wherein the stop is a rod, the rod having a free end adapted to engage the free piston, and the end of the rod opposite the free end being adjustably mounted with a support thereby to vary the location of the rod relative to the cylinder.

32. Apparatus for filling containers with a flowable substance from a supply comprising means for conveying containers along a path, the path passing through a filling station, a plurality of nozzles for movement along at least part of the path together with the associated containers, a plurality of cylinders mounted for movement along at least part of the path together with the containers, each cylinder having respective opposite ends and each cylinder having a free piston movable in each cylinder towards opposite ends of the cylinder, a plurality of spool valve assemblies associated with each respective cylinder for alternately connecting respectively each valve assembly to the respective opposite end of the each cylinder for charging and discharging the respective opposite ends with the flowable substance, each valve assembly alternately connecting a nozzle to a respective opposite end of a cylinder for discharging the flowable substance from the supply and/or connected cylinder end into a container, means for mechanically operating the valve assemblies to regulate supply of the flowable substance into the container, each cylinder having a cylinder volume, and including a stop for entering one end of each cylinder, the stop being adapted for location in each cylinder to variable extends thereby effectively to adjust the cylinder volume.

33. Apparatus as claimed in claim 32 wherein the stop is a rod, the rod having a free end adapted to engage the free piston, and the end of the rod opposite the free end being adjustably mounted with a support thereby to vary the location of the rod relative to the cylinder.

34. Apparatus as claimed in claim 32 wherein each valve assembly includes a sleeve body mounted relative to a rotational axis of the conveyer, the conveyer being a circular turntable with a circumference.

35. Apparatus as claimed in claim 34 wherein the sleeve body includes a valve spool for reciprocating movement, and the means for mechanically operating the valve assemblies includes interacting members located partly about the circumference of the turntable, the interacting members being stationary relative to the turntable.

36. Apparatus as claimed in claim 35 wherein the interacting members are spaced circumferentially about the turntable, and the interacting members include a first element and a second element, and whereby in one circumferential position of the turntable the valve spool interacts with the first element of the interacting members to activate the valve assembly into a first position and in a second circumferential position the second element of the interacting members interacts with the valve spool to activate the valve assembly into a second operative position.

37. A method for filling containers with a flowable substance from a supply comprising conveying containers along a path, the path passing through filling station, moving a plurality of nozzles along at least part of the path, together with the containers, moving a plurality of cylinders having opposite ends along at least part of the path together with the containers, each cylinder having a free piston movable in the cylinder towards opposite ends of the cylinder, each cylinder end being in fluid communication with a respective spool valve, alternately connecting a spool valve with opposite ends of an associated cylinder, and connecting the supply with an associated nozzle whereby fluid from the supply and/or cylinder fills the containers, the valves being mechanically operated, and wherein each cylinder has a volume and including adjusting the cylinder volume by entering the cylinder with a stop for location to a variable extent.

38. Apparatus for filling containers with a flowable substance from a supply comprising means for conveying containers along a path, the path passing through a filling station, a plurality of nozzles for movement along at least part of the path together with the associated containers, a plurality of cylinders mounted for movement along at least part of the path together with the containers, each cylinder having respective opposite ends and each cylinder having a free piston movable in each cylinder towards opposite ends of the cylinder, a plurality of spool valve assemblies associated with each respective cylinder for alternatively connecting respectively each valve assembly to the respective opposite end of each cylinder for charging and discharging the respective opposite ends with the flowable substance, each valve assembly alternately connecting a nozzle to a respective opposite end of a cylinder for discharging the flowable substance from the supply and/or connected cylinder end into a container, means for mechanically operating the valve assemblies to regulate supply of the flowable substance into the container, wherein the path includes a rotary conveyer having a turntable, the cylinders being mounted above the turntable and the valve assemblies being mounted in adjacency with the cylinders below the turntable.

39. Apparatus as claimed in claim 38 wherein each cylinder has a cylinder volume, and including a stop for entering one end of each cylinder, the stop being adapted for location in each cylinder to variable levels thereby effectively to adjust the cylinder volume.

40. Apparatus as claimed in claim 39 wherein the stop is a rod, the rod having a free end adapted to engage the free piston, and the end of the rod opposite the free end being adjustably mounted with a support thereby to vary the location of the rod relative to the cylinder.

41. Apparatus as claimed in claim 40 wherein the support is a horizontal plate vertically movable thereby to adjust the stop location in the cylinder.

42. Apparatus as claimed in claim 41 wherein the stop is adjustable during rotation of the turntable.

43. Apparatus as claimed in claim 40 wherein the piston includes ends having an indentation, and wherein the free end of the rod includes an end to mate with the indentation in the one end of the piston.

44. Apparatus as claimed in claim 43 wherein the indentation is a conical inward taper.

45. Apparatus as claimed in claim 39 wherein the stop is adjustable during rotation of the turntable.

46. Apparatus as claimed in claim 38 wherein each valve assembly includes an elongated sleeve body mounted radially relative to a rotational axis of the conveyer, the conveyer being a circular turntable with a circumference.

47. Apparatus as claimed in claim 46 wherein the sleeve body includes an elongated casing with a valve spool adapted for axial reciprocating movement in the casing, such axial movement being radial relative the rotational axis, and the means for mechanically operating the valve assemblies includes interacting members located partly about the circumference of the turntable, the interacting members being stationary relative to the turntable.

48. Apparatus as claimed in claim 47 wherein the interacting members are spaced circumferentially about the turntable, and the interacting members include a first element and a second element, and whereby in one circumferential position of the turntable the valve spool interacts with the first element of the interacting members to activate the valve assembly into a first position and in a second circumferential position the second element of the interacting members interacts with the valve spool to activate the valve assembly into a second operative position.

49. Apparatus as claimed in claim 48 wherein the elongated casing includes opposite ends to the sleeve body, and the valve spool includes extensions protruding from the valve casing to ends of the valve casing, the extensions being for interaction respectively with the first and second elements of the interacting members.

50. Apparatus as claimed in claim 49 wherein the extensions to the valve spool include a hemispherical end and the elements of the interactive members are arcuate sections spaced circumferentially about the turntable.

51. Apparatus as claimed in claim 50 wherein the arcuate sections are spring loaded towards the spool valve assemblies.

52. A method for filling containers with a flowable substance from a supply comprising conveying containers along a path, the path passing through filling station, moving a plurality of nozzles along at least part of the path, together with the containers, moving a plurality of cylinders having opposite ends along at least part of the path together with the containers, each cylinder having a free piston movable in the cylinder towards opposite ends of the cylinder, each cylinder end being in fluid communication with a respective spool valve, alternately connecting a spool valve with opposite ends of an associated cylinder, and connecting the supply with an associated nozzle whereby fluid from the supply and/or cylinder fills the containers, the valves being mechanically operated, wherein the cylinder has a volume and including adjusting the cylinder volume by entering one of the opposite ends of the cylinder with a stop for location in the cylinder to a variable extent.

53. A method as claimed in claim 52 including engaging the free piston with the stop and adjustably mounting the stop with a support.

54. A method as claimed in claim 53 including a rotational axis and a circumference for the turntable and axially reciprocating a valve spool in a casing, such axial movement being radially directed relative the rotational axis, and operatively interacting the valve with interacting members located partly about the circumference of the turntable.

55. A method as claimed in claim 53 including moving the support vertically thereby to adjust the location of the stop location in the cylinder.

56. A method as claimed in claim 55 wherein the stop is adjustable during the rotation of the turntable.

* * * * *